US010602883B2

(12) United States Patent
Broe

(10) Patent No.: US 10,602,883 B2
(45) Date of Patent: Mar. 31, 2020

(54) SHOWER CURTAIN BLOCKING DEVICE

(71) Applicant: Jesper Schrøder Broe, Karlslunde (DK)

(72) Inventor: Jesper Schrøder Broe, Karlslunde (DK)

( * ) Notice: Subject to any disclaimer, the term of this patent is extended or adjusted under 35 U.S.C. 154(b) by 0 days.

(21) Appl. No.: 16/414,237

(22) Filed: May 16, 2019

(65) Prior Publication Data

US 2019/0274486 A1 Sep. 12, 2019

Related U.S. Application Data

(63) Continuation of application No. PCT/DK2017/050362, filed on Nov. 3, 2017.

(30) Foreign Application Priority Data

Nov. 30, 2017 (DK) ..... 2016 00735

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/610
See application file for complete search history.

(56) References Cited

U.S. PATENT DOCUMENTS 4,361,914 A 12/1982 Oliver
5,732,420 A * 3/1998 Micciche ..... A47K 3/38 4/559
7,171,705 B1 * 2/2007 Hicks ..... A47K 3/003 292/262
8,201,286 B1 6/2012 Parker
10,206,543 B2 * 2/2019 Maner ..... A47K 3/38
2005/0268394 A1 12/2005 Monk et al.
2008/0289095 A1 11/2008 Li
2011/0094985 A1 4/2011 Austin
2015/0223643 A1 8/2015 Mason

FOREIGN PATENT DOCUMENTS

CH 643448 6/1984

OTHER PUBLICATIONS

International Search Report and Written Opinion dated Jan. 18, 2018 for International Patent Application No. PCT/DK2017/050362.
Danish Search Report dated Jun. 1, 2017 for Danish Patent Application No. PA 2016 00735 (relevant citations in English).

* cited by examiner

*Primary Examiner* — Huyen D Le
(74) *Attorney, Agent, or Firm* — Lathrop GPM LLP

(57) ABSTRACT

A blocking device for preventing the motion of a shower curtain arranged in a shower cabinet comprising one or more walls is disclosed.

The blocking device comprises a rod member configured to be arranged in a position in which the rod member prevents the shower curtain from being sucked into the shower cabinet. The blocking device comprises a mounting element configured to enable the rod member to be detachably attached to a wall by means of the mounting element configured to be attached to the wall.

8 Claims, 5 Drawing Sheets

Prior Art

Fig. 5A
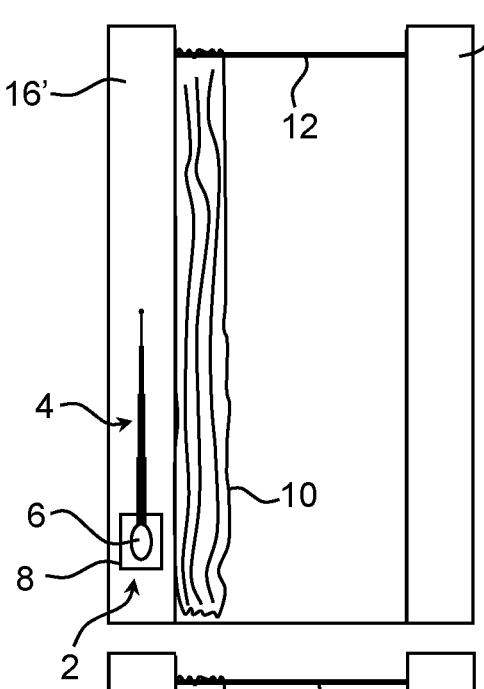
Fig. 5B
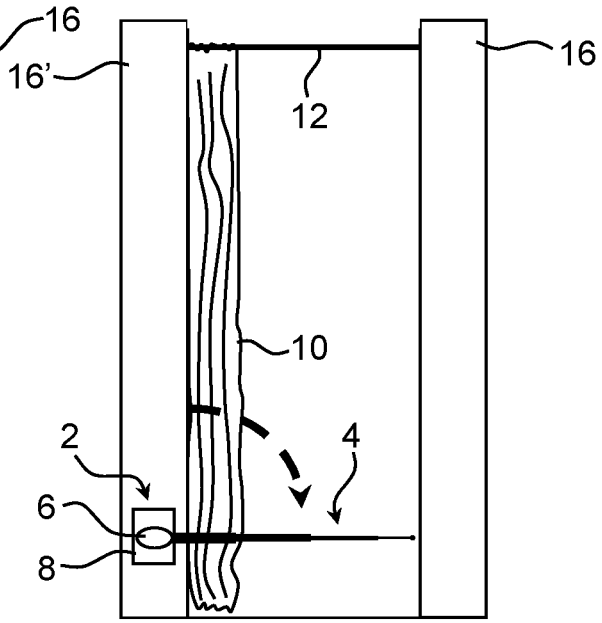
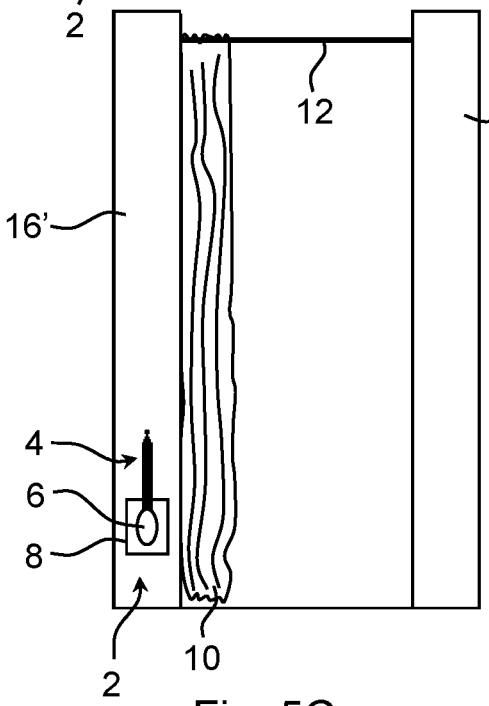
Fig. 5C
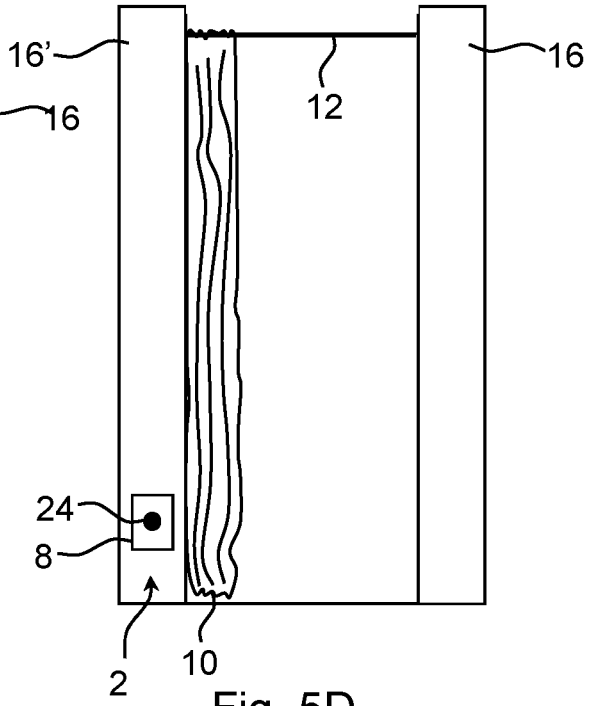
Fig. 5D

SHOWER CURTAIN BLOCKING DEVICE

CROSS-REFERENCE TO RELATED APPLICATIONS

This application is a continuation of International Application No. PCT/DK2017/050362, filed Nov. 3, 2017, which claims priority to Danish Patent Application No. PA 2016 00735, filed Nov. 30, 2016, the entire contents of which are hereby incorporated by reference into this application.

FIELD OF INVENTION

The present invention relates to a blocking device for preventing the motion of a shower curtain arranged in a shower cabinet comprising one or more walls.

PRIOR ART

Many shower cabinets are provided with a shower curtain slidably attached to a suspension member extending between adjacent walls of the shower cabinet. The shower curtain is often slidably attached to the suspension member by means of a plurality of ring members that surround the suspension member and are attached to the shower curtain.

When the user of the shower cabinet has entered the shower cabinet and turns on the shower, the water from the shower will create a low pressure inside the shower cabinet. Accordingly, the shower curtain will be sucked into the shower cabinet and be brought into contact with the user. For many users the motion of the shower curtain is undesired and makes it uncomfortable for the user to take a shower.

Accordingly, it would be desirable to be able to prevent the undesired motion of the shower curtain and hereby avoid the uncomfortable experiences that is associated with the use of prior art shower cabinets provided with a shower curtain.

E.g. US 2011/094985 A1 discloses an adjustable extendible arm mounted on the shower wall having two positions, stowed and active, respectively. In the active position, the device is positioned against the shower curtain pushing the mid to the upper portion of the shower curtain outboard of the shower area. The device has a flat plate with two ears which captivate the arm between them. A carriage bolt passes through holes in the three parts. The device is fastened to the shower wall, suitably by screws. However, the device is in "one-piece", whereby it cannot be detached if the shower occupant accidentally hits the device.

It is an object of the invention to be able to prevent the undesired motion of the shower curtain and avoid the uncomfortable experiences that are associated with the use of prior art shower cabinets provided with a shower curtain.

It is also an object of the invention to provide a solution to the above-mentioned problem in a manner that is safe for the user.

SUMMARY OF THE INVENTION

The object of the present invention can be achieved by a blocking device as defined in claim 1. Preferred embodiments are defined in the dependent sub claims, explained in the following description and illustrated in the accompanying drawings.

The blocking device according to the invention is a blocking device for preventing the motion of a shower curtain arranged in a shower cabinet comprising one or more walls, wherein the blocking device comprises a rod member configured to be arranged in a position in which the rod member prevents the shower curtain from being sucked into the shower cabinet, wherein the blocking device comprises a mounting element configured to enable the rod member to be detachably attached to a wall by means of the mounting element configured to be attached to the wall. The blocking device comprises an attachment structure attached to the proximal end of the rod member and a mounting member comprising a first surface configured to be attached to the wall, wherein a magnetic member is attached to the attachment structure and that magnetic member is attached to the mounting member, wherein the magnetic members are configured and arranged to be attached to each other by means of magnetic attraction between the magnetic members.

Hereby, it is possible to provide a blocking device that can prevent undesired motion of a shower curtain and avoid the uncomfortable experiences that are associated with the use of prior art shower cabinets provided with a shower curtain.

Moreover, it is possible to provide a blocking device that is safe for the user to use. The detachable feature ensures the user not being able to stumble over or even break the device when it is in use.

The blocking device according to the invention is a blocking device for preventing that a shower curtain is sucked into a shower cabinet. Accordingly, the blocking device is in particular configured to prevent horizontal displacement of the shower curtain.

The blocking device can be used in different types of cabins comprising one or more walls, wherein the blocking device comprises a rod member (which acts as a boom barrier) configured to be arranged in a position in which the rod member prevents the shower curtain from being sucked into the shower cabinet. The rod member may be produced in any suitable material including metal (e.g. stainless steel or aluminium), wood, plastic or rubber or combinations thereof.

The rod member may have any suitable geometric shape. It may be an advantage that the rod member is formed as an elongated element e.g. such as a pipe or a massive rod.

The blocking device comprises a mounting element configured to enable the rod member to be detachably attached to a wall by means of the mounting element configured to be attached to the wall.

The mounting element may be a one-piece body or comprise several structures fixedly or removably attached to each other.

It is possible to detachably attach the attachment structure to the mounting member. Accordingly, the rod member can be detached from the mounting member by detaching the attachment structure from the mounting member.

The attachment structure may be attached to the rod member by any suitable means (including adhesive and mechanical attachment means such as screws) or be integrated (e.g. embedded) in the rod member.

It may be beneficial that the blocking device comprises one or more suction cups arranged in a position in which they can be attached to the wall and hereby detachably attach the blocking device to the wall.

Hereby, it is possible to detachably attach the rod member to the wall in an easy manner. Moreover, it is possible to produce a simple and cheap blocking device.

One or more suctions cups may be attached to the rod member. The one or more suctions cups may be inserted into a bore (e.g. a through-going bore) provided in the rod member.

By the invention, it is possible to provide a simple and reliable blocking device enabling an easy detachment of the rod member so that the user will not get hurt or break the device when walking into the rod member. Furthermore, when the user is done with the shower, the rod can quickly be raised in vertical position like a boom barrier, or the user can choose to detach it completely.

The magnetic member may be a permanent magnet or a ferromagnetic structure made of iron, nickle, cobolt or rear earth metal.

It may be advantageous that the rod member is a telescopic rod member comprising a plurality of segments, wherein the adjacent segments are slidably arranged within another.

Thus, the rod member is capable of being extended or shortened depending on its configuration. Accordingly, the rod member does not fill up a lot of space when being transported or stored (when it is not used).

It may be beneficial that the mounting structure comprises a first portion and a second portion attached to each other. It may be an advantage that the first portion and a second portion extend basically perpendicular to each other.

Hereby, it is possible to attach the rod member to a wall that extends perpendicular to the intended direction of the rod member, which is required in certain types of cabins.

It may be an advantage that the first portion and a second portion are fixedly attached to each other. Hereby, it is possible to produce a simple, reliable and cheap mounting structure.

It may be advantageous that the first portion and the second portion are rotatably attached to each other by means of a hinge.

Hereby, it is possible to rotate the first portion relative to the second portion in order to regulate the direction of the rod member relative to the wall to which the mounting structure is attached, making it useful in all types of cabins.

It may be an advantage that the hinge comprises a structure configured to ensure that a force having a predefined minimum magnitude is required in order to rotate the first portion relative to the second portion and hereby the rod member relative to the wall to which the mounting structure is attached.

Hereby, it is achieved that the rod member does not rotate when the shower curtain is brought into contact with the rod member.

It is preferred the rod member is attached to the wall in a manner in which it is secured that the rod member will remain attached to the wall unless a force of a predefined magnitude is applied towards the rod member (e.g. in a direction perpendicular to the longitudinal axis of the rod member).

It may be an advantage that the mounting structure comprises a surface provided with an adhesive member.

Hereby, it is possible to attach the mounting structure to a wall in an easy, reliable and fast manner.

The adhesive member may be double adhesive tape or any other suitable adhesive structure.

It may be beneficial that the magnetic member of the attachment structure or the mounting structure protrudes from the attachment structure or the mounting structure, respectively.

Hereby, it is possible to provide an attachment that allows for an easy detachment of the rod member.

It may be an advantage that the magnetic member of the attachment structure protrudes from the attachment structure.

It may be beneficial that the magnetic member of the mounting structure protrudes from the mounting structure.

It may an advantage that the magnetic member of the mounting structure and a surface of the mounting structure are aligned.

Hereby the magnetic member does not protrude from the mounting structure.

It may be advantageous that the magnetic member of the attachment structure and a surface of the attachment structure are aligned.

It may be beneficial that the magnetic member of the attachment structure is provided in a recess in the attachment structure, wherein the attachment structure protrudes from the magnetic member.

It may be an advantage that the magnetic member of the mounting structure is provided in a recess in the mounting structure, wherein the mounting structure protrudes from the magnetic member.

It may be beneficial that a magnet or a magnetic member is embedded into the attachment structure.

It may be beneficial that a magnet or a magnetic member is embedded into the mounting structure.

It may be beneficial that the magnet or magnetic member is coated with a protective coating. A protective coating may e.g. comprise a multiple layer plating of Nickel-Copper-Nickel (Ni—Cu—Ni) or one or more of the following nickel (Ni), epoxy, zinc (Zn), gold (Au), silver (Ag), tin (Sn), titanium (Ti), titanium nitride (TiN), parylene C, everlube, chrome, PTFE or a combination thereof.

DESCRIPTION OF THE DRAWINGS

The invention will become more fully understood from the detailed description given herein below. The accompanying drawings are given by way of illustration only, and thus, they are not limitative of the present invention. In the accompanying drawings:

FIG. 5A shows a front view of a blocking device according to the invention;

FIG. 5B shows a front view of the blocking device shown in FIG. 5A in a configuration in which the rod member of the blocking device has been rotated;

FIG. 5C shows a front view of the blocking device shown in FIG. 5A in a configuration in which the segments of the rod members are pressed together and FIG. 5D shows a front view of the blocking device shown in FIG. 5A in a configuration in which the rod member and the attachment structure have been detached from the mounting structure.

DETAILED DESCRIPTION OF THE INVENTION

Figure 1A:
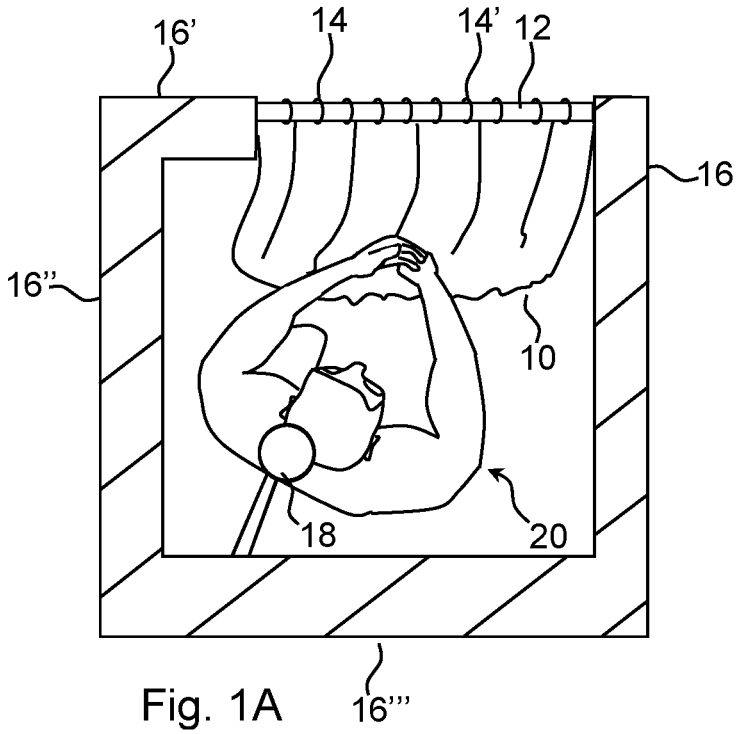
FIG. 1A shows a schematic top view of a typical prior art shower cabinet provided with a shower curtain.
Figure 1B:
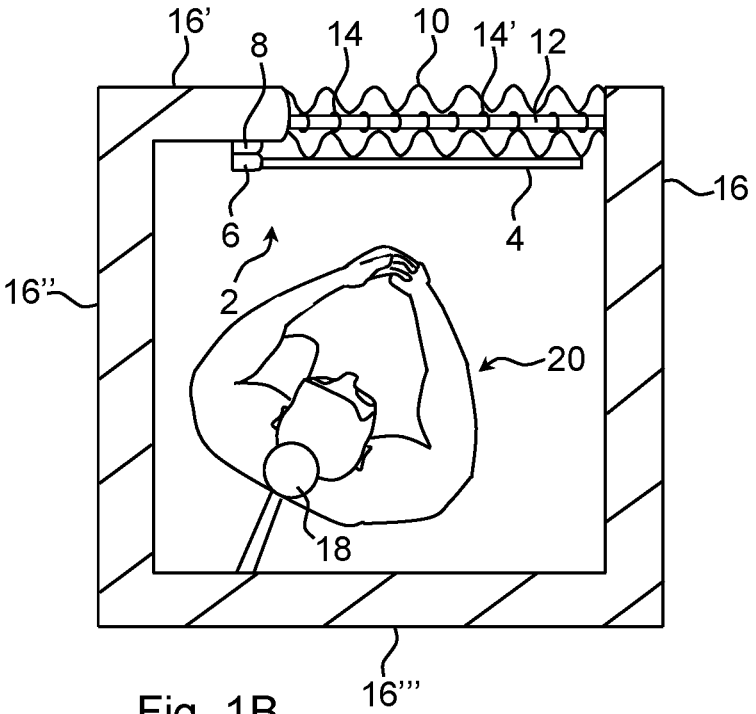
FIG. 1B shows a schematic top view of a shower cabinet provided with a shower curtain and a blocking device according to the invention.

Referring now in detail to the drawings for the purpose of illustrating preferred embodiments of the present invention, a blocking device 2 of the present invention is illustrated in FIG. 1B. For illustrating one drawback associated to a shower curtain 10 mounted in prior art shower cabinet, FIG. 1A shows a schematic top view of a typical prior art shower cabinet provided with a shower curtain 10. The shower cabinet comprises four walls 16, 16', 16", 16''' and a cylindrical hollow suspension member 12 extending between two of the walls 16, 16'. The shower curtain 10 is slidably attached to the suspension member 12 by means of a plurality of ring members 14, 14' that surrounds the suspension member 12 and are attached to the shower curtain 10.

When the user 20 turns on the shower 18, the water will create a low pressure inside the shower cabinet. Accordingly, the shower curtain 10 will be sucked into the shower cabinet and be brought into contact with the user 20. For many users 20 this undesired motion of the shower curtain 10 makes it uncomfortable to take a shower.

Accordingly, it would be desirable to be able to prevent the undesired motion of the shower curtain 10 in order to avoid the uncomfortable experiences that are associated with the use of prior art shower cabinets provided with a shower curtain 10.

FIG. 1B illustrates a schematic top view of a shower cabinet provided with a shower curtain 10 and a blocking device 2 according to the invention. Like in FIG. 1A, the shower cabinet comprises four walls 16, 16', 16", 16''' and a suspension member 12 extending between two of the walls 16, 16'. The shower curtain 10 is movably attached to the suspension member 12 by means of a plurality of ring members 14, 14' slidably attached to the suspension member 12 and being attached to the shower curtain 10. A user 20 inside the shower cabinet has turned on the shower, however, the shower curtain 10 is not sucked into the shower cabinet because the blocking device 2 prevents the shower curtain 10 from being moved towards the user 20.

The blocking device 2 comprises an elongated rod member 4 attached to an attachment structure 6. The attachment structure 6 is removably attached to a mounting structure 8 attached to the inside of the wall 16'.

The attachment structure 6 may be removably attached to the mounting structure 8 by means of corresponding magnets (or a magnet and a corresponding ferromagnetic (e.g. iron, nickle, cobolt or rear earth metal) structure fixed to the attachment structure 6 and the mounting structure 8, respectively. The attachment structure 6 may be removably attached to the mounting structure 8 by means of other suitable attachment means (e.g. mechanical structures). The mounting structure 8 may be attached to the wall 16' by means of adhesive (e.g. adhesive tape or glue) or by mechanical means such as screws or corresponding mechanical attachment members.

Since the attachment structure 6 is removably attached to the mounting structure 8, the attachment structure 6 falls off if the user 20 forgets to remove it and unintendedly walks into it when leaving the shower cabinet. Accordingly, the attachment structure 6 will not break nor harm the user 20. Likewise, by having an attachment structure 6 that is removably attached to the mounting structure 8, the attachment structure 6 can easily be removed and stored somewhere else when the user 20 has finished a bath or the rod can simply be lifted up to a vertical position like a boom barrier being raised.

The rod member 4 extends parallel to the wall 16'. The rod member 4 extends parallel to the suspension member 12.

Figure 2A:
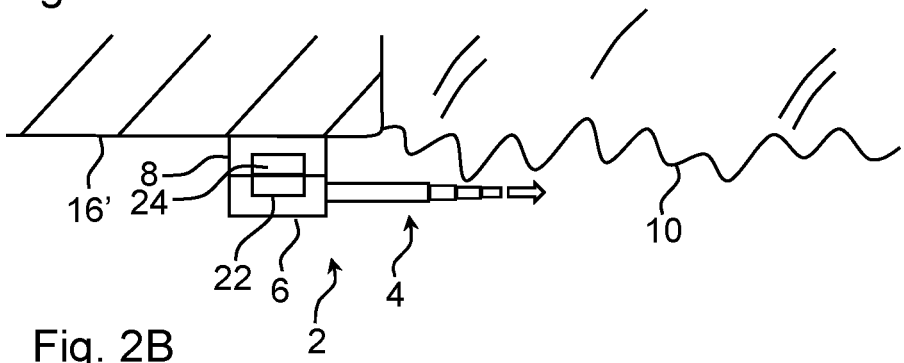
FIG. 2A shows a schematic top view of a telescopic blocking device according to the invention mounted on a wall of a shower cabinet, wherein the blocking device is in a compressed state.

FIG. 2A illustrates a schematic top view of a telescopic blocking device 2 according to the invention mounted on a wall 16' of a shower cabinet, wherein the blocking device 2 is in a compressed state. The blocking device 2 comprises a telescopic rod member 4 having a plurality of segments, wherein the adjacent segments are slidably arranged within another. Thus, the rod member 4 is capable of being extended or shortened depending on its configuration.

The blocking device 2 furthermore comprises an attachment structure 6 attached to the proximal end of the rod member 4 and a mounting structure 8 attached to the wall 16'. A magnet 22 is fixedly attached to the attachment structure 6. A magnet 24 is attached to the mounting structure 8 in a manner that allows the attachment structure 6 to be attached to the mounting structure 8 by magnetic attraction between the magnets 22, 24. Instead of using magnets 22, 24 one of the magnets may be replaced by ferromagnetic (e.g. iron, nickle, cobolt or rear earth metal) structures. The mounting structure 8 may be attached to the wall 16' by any suitable means e.g. double adhesive tape.

The rod member 4 of the blocking device 2 is configured to be extended in order to prevent the motion of the shower curtain 10 provided in the shower cabinet.

Figure 2B:
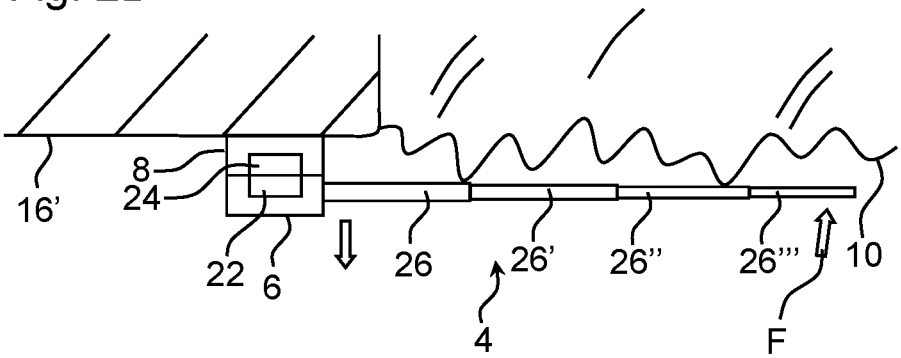
FIG. 2B shows a schematic top view of the telescopic blocking device shown in FIG. 2A, wherein the blocking device is in an extended state.

FIG. 2B illustrates a schematic top view of the telescopic blocking device 2 shown in FIG. 2A, wherein the blocking device 2 is in an extended state. The rod member 4 of the blocking device 2 comprises four segments 26, 26', 26", 26'''. Each segment 26, 26', 26", 26''' is slidably attached to its adjacent segment 26, 26', 26", 26'''.

The rod member 4 prevents the shower curtain 10 from being sucked into the shower cabinet.

A force F is applied towards the distal portion (segment 26''') of the rod member 4. Accordingly, the attachment structure 6 of the blocking device 2 is detached from the mounting structure 8 as indicated (with a dotted line). Accordingly, the blocking device 2 is safe to use since the attachment structure 6 of the blocking device 2 is easily detached from the mounting structure 8.

Figure 2C:
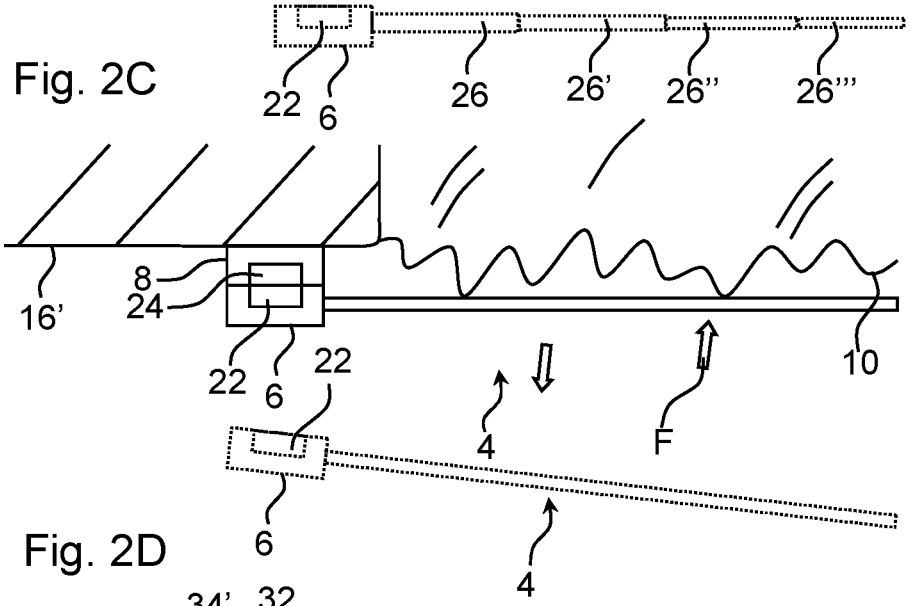
FIG. 2C shows a schematic top view of another blocking device according to the invention mounted on a wall of a shower cabinet.

FIG. 2C illustrates a schematic top view of another blocking device 2 per the invention mounted on a wall 16' of a shower cabinet. The blocking device 2 basically corresponds to the blocking device 2 shown in FIG. 2B. The rod member 4, however, is formed as a one-piece body. This one-piece body may be a pipe or a massive rod. A force F large enough to detach the attachment structure 6 of the blocking device 2 from the mounting structure 8 is applied towards the rod member 4. Therefore, the attachment structure 6 of the blocking device 2 is detached from the mounting structure 8 (indicated with a dotted line).

Figure 2D:
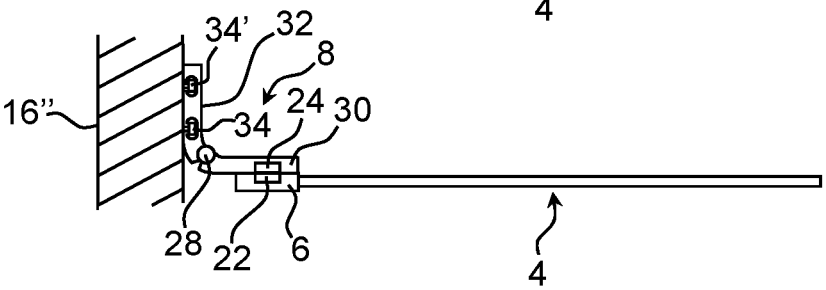
FIG. 2D shows a schematic top view of a further blocking device according to the invention mounted on a wall of a shower cabinet.

FIG. 2D illustrates a schematic top view of a further blocking device 2 according to the invention mounted on a wall 16" of a shower cabinet. The blocking device 2 comprises a straight rod member 4 attached to an attachment structure 6 in its rod member 4. The attachment structure 6 comprises a magnetic structure 22 fixedly attached to a recess provided in the attachment structure 6. The blocking device 2 furthermore comprises a mounting structure 8 to which the attachment structure 6 is attached. The mounting structure 8 comprises a first portion 30 and a second portion 32 rotatably attached to each other by means of a hinge 28. A magnetic member 24 is fixedly arranged in a recess provided in the first portion of the mounting structure 8. Accordingly, the attachment structure 6 is removably attached to the first portion of the mounting structure 8 by magnetic attraction between the magnetic members 22, 24. The magnetic members 22, 24 may be permanent magnets or a magnet and a ferromagnetic (e.g. iron, nickle, cobolt or rear earth metal) structure. The second portion 32 is attached to the wall 16" by means of two screws 34, 34' screwed into the wall 16", wherein the screws are received by recesses provided in the second portion 32. Accordingly, the second portion 32 can be removably attached to the wall 16".

The first portion 30 and the second portion 32 are formed as plate structures extending basically perpendicular to each other. The mounting structure 8 is configured to be arranged in a configuration as shown in FIG. 2D. However, it may be an advantage that the mounting structure 8 is configured to be arranged in a configuration, in which the first portion 30 and the second portion 32 basically extend parallel to each other.

In one embodiment according to the invention, the mounting structure 8 comprises a first portion 30 and a second portion 32 which are formed as plate structures extending basically perpendicular to each other, wherein the first portion 30 and a second portion 32 are fixed to each other and thus comprise no joint (hinge) presenting a cheaper solution but not compatible with all cabin types.

Figure 3A:
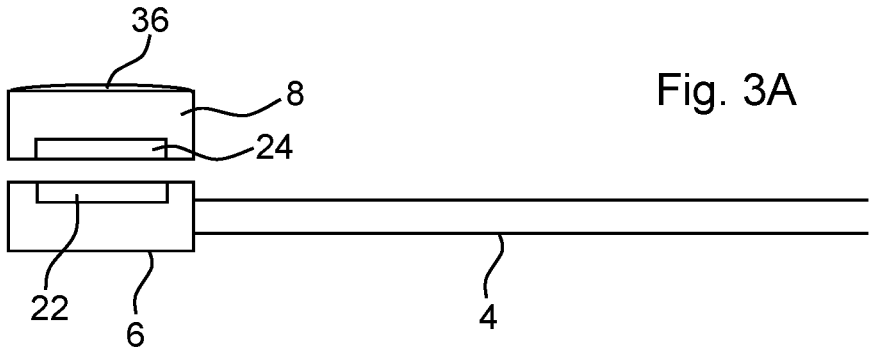
FIG. 3A shows a schematic top view of a blocking device according to the invention.

FIG. 3A illustrates a schematic top view of a blocking device 2 according to the invention. The blocking device 2 comprises a rod member 4 attached to an attachment structure 6 provided with a permanent magnet 22. The blocking device 2 comprises a mounting structure 8 provided with a permanent magnet 24 arranged to attract the corresponding magnet 22 of the attachment structure 6. Accordingly, the north pole and the south pole of the magnets 22, 24 must be arranged in such a manner that a south pole of the first magnet faces the north pole of the opposite magnet.

The mounting structure 8 is provided with an adhesive member 36 arranged at the opposite surface than the surface in which the magnet 24 is arranged. The adhesive member 36 may be a double adhesive tape or glue.

Figure 3B:
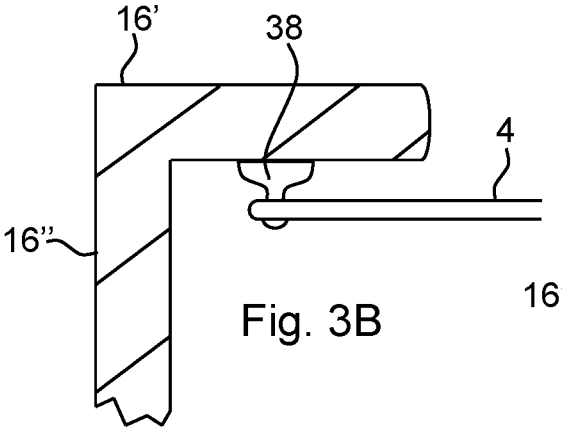
FIG. 3B shows a schematic top view of a blocking device according to the invention comprising a suction cup mounted on a wall of a shower cabinet.

FIG. 3B illustrates a schematic top view of a blocking device 2 according to the invention comprising a suction cup 38 mounted on a wall 16' of a shower cabinet. The blocking device 2 comprises a rod member 4 extending parallel to a first wall 16' of the shower cabinet and perpendicular to a second wall 16" of the shower cabinet.

Figure 3C:
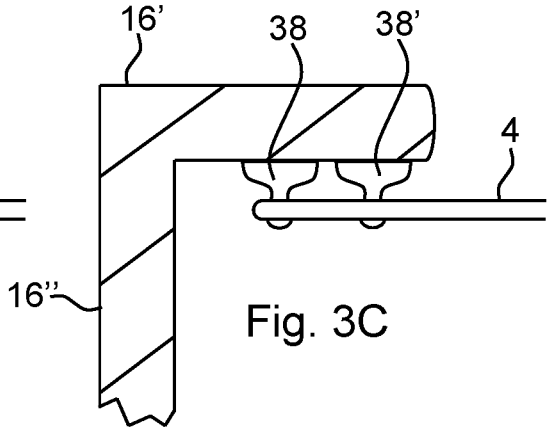
FIG. 3C shows a schematic top view of a blocking device according to the invention comprising two suction cups mounted on a wall of a shower cabinet.

FIG. 3C illustrates a schematic top view of a blocking device 2 according to the invention comprising two suction cups 38, 38' mounted on a wall 16' of a shower cabinet. The blocking device 2 basically corresponds to the one shown in FIG. 3B, however, it comprises an additional suction cup 38' attached to the rod member 4.

Figure 3D:
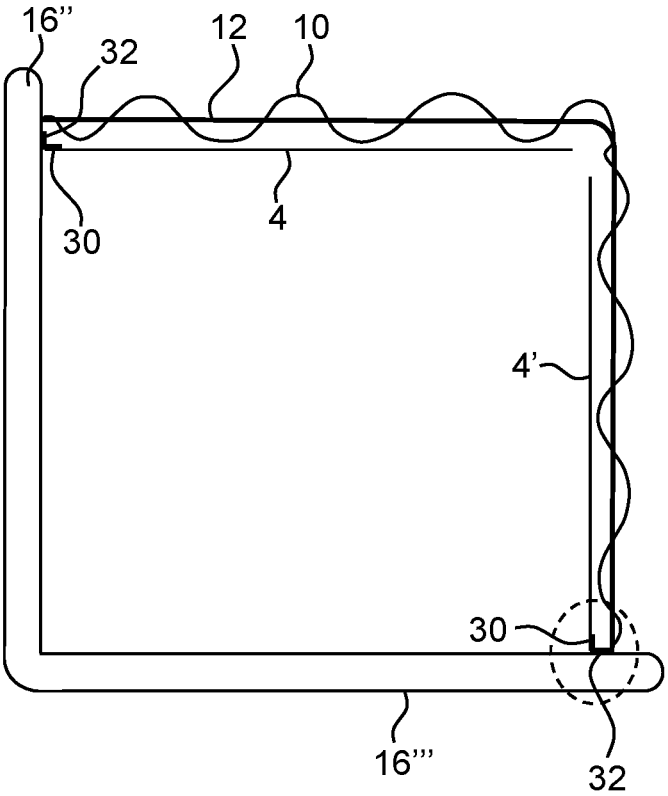
FIG. 3D shows a schematic top view of two blocking devices according to the invention mounted on walls of a shower cabinet.

FIG. 3D illustrates a schematic top view of two blocking devices 2, 2' according to the invention mounted on walls 16", 16''' of an L-shaped shower cabinet. A shower curtain 10 is slidably attached to an L-shaped suspension member 12 (extending between the walls 16", 16''') in order to closely cover the opening of the shower cabinet.

The first blocking devices 2 comprise a rod member 4 attached to a mounting structure comprising a first portion 30 and a second portion 32. The second portion 32 of the mounting structure is attached to the first wall 16". The rod member 4 of the blocking devices 2 extends perpendicular to the first wall 16" and parallel to the second wall 16'''.

The second blocking devices 2' comprise a rod member 4' attached to a mounting structure comprising a first portion 30 and a second portion 32.

The second portion 32 of the mounting structure is attached to the second wall 16'''. The rod member 4' of the blocking devices 2' extends parallel to the first wall 16" and perpendicular to the second wall 16'''.

The blocking devices 2, 2' are removably attached to the walls 16", 16''' and therefore the rod members 4, 4' can be raised or detached easily when the rod members 4, 4' are no longer required to prevent the shower curtain 10 from being sucked into the shower cabinet. Furthermore, the risk of getting hurt by the rod members 4, 4' is eliminated by applying detachably attached rod members 4, 4'.

Figure 3E:
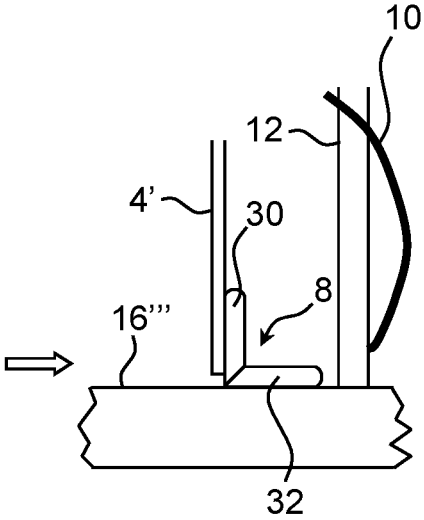
FIG. 3E shows a close-up view of the proximal portion of one of the blocking devices shown in FIG. 3E.

FIG. 3E illustrates a close-up view of the proximal portion of the second blocking device 2' shown in FIG. 3E. It can be seen that the rod member 4' of the blocking device 2' is attached to a mounting member 8 having a first portion 30 and a second portion 32 fixedly attached to each other. The second portion 32 is permanently attached to the wall 16''' (e.g. by means of double adhesive tape or glue).

Figure 4B:
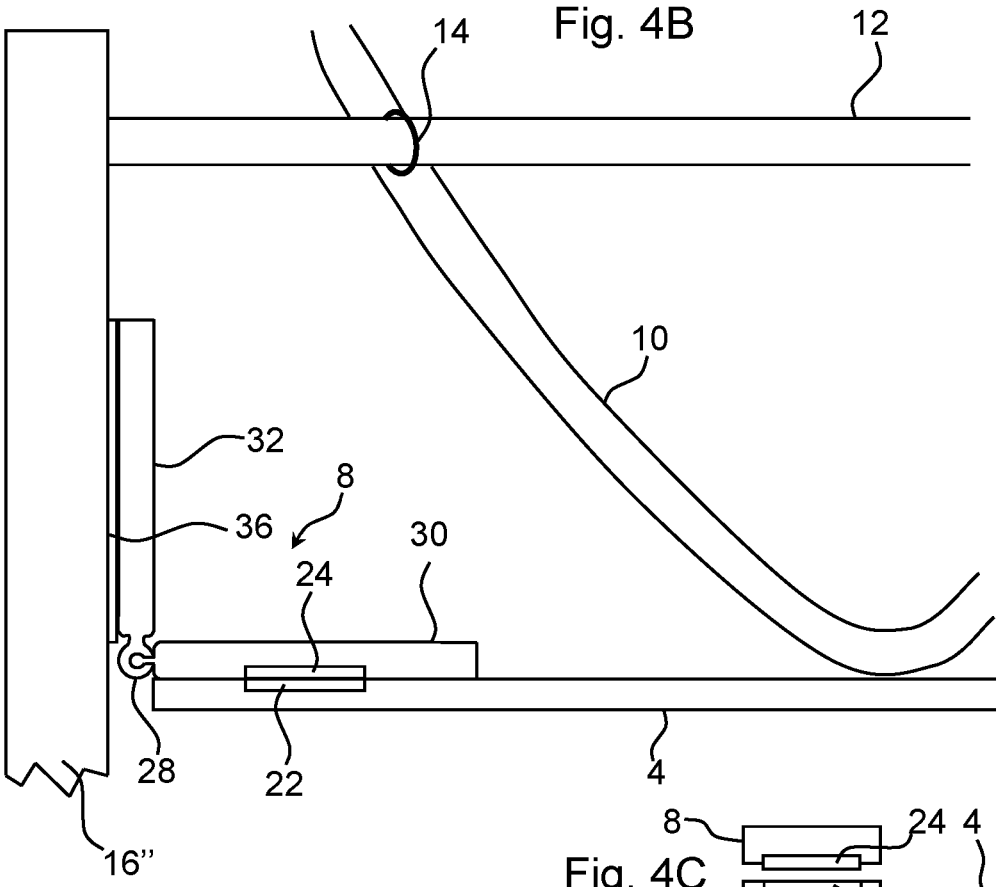
FIG. 4B shows a close-up view of the proximal portion of the blocking device shown in FIG. 4A.
Figure 4A:
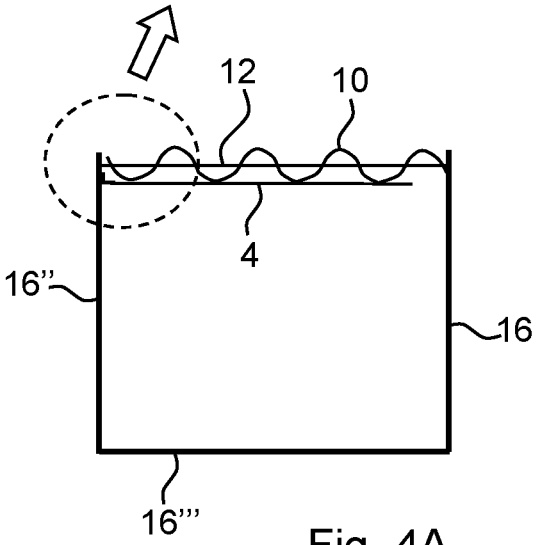
FIG. 4A shows a schematic top view of a blocking device according to the invention mounted on a wall of a shower cabinet.

FIG. 4A illustrates a schematic top view of a blocking device 2 according to the invention mounted on a wall 16" of a shower cabinet comprising three walls 16", 16''', 16. A shower curtain 10 is slidably attached to a straight suspension member 12 extending between the walls 16", 16. The shower curtain 10 is configured and arranged to cover the opening of the shower cabinet. The blocking device 2 comprises a rod member 4 extending parallel to the wall 16''' and is arranged to prevent the shower curtain 10 from being sucked into the shower cabinet.

FIG. 4B illustrates a close-up view of the proximal portion of the blocking device 2 shown in FIG. 4A. It can be seen that the rod member 4 comprises a magnet 22 that is brought into contact with a corresponding magnet 24 fixedly attached to a first portion 30 of an L-shaped mounting structure 8. The L-shaped mounting structure 8 comprises a second portion 32 rotatably attached to the first portion 30 of an L-shaped mounting structure 8 by means of a hinge 28. The second portion 32 is attached to the wall 16". The second portion 32 may be attached to the wall 16" by means of adhesive (e.g. double adhesive tape) or other means of fastening (e.g. screws). It can be seen that the shower curtain 10 is slidably attached to a tubular suspension member 12 by means of rings 14 surrounding the suspension member 12 and being attached to the shower curtain 10.

Figure 4C:
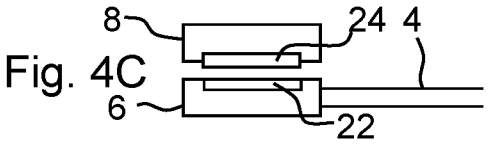
FIG. 4C shows a close-up view of the proximal portion of a blocking device according to the invention.

FIG. 4C illustrates a close-up view of the proximal portion of a blocking device according to the invention. The blocking device comprises a rod member 4 attached to an attachment structure 6 provided with a magnetic member 22 having an outer surface aligned with the surface of the attachment structure 6 that faces the mounting structure 8 provided above the attachment structure 6. The mounting structure 8 is provided with a magnetic member 24 protruding from the surface of the mounting structure 8 that faces the attachment structure 6.

Figure 4D:
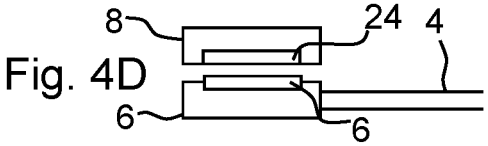
FIG. 4D shows a close-up view of the proximal portion of another blocking device according to the invention.

FIG. 4D illustrates a close-up view of the proximal portion of another blocking device according to the invention. The blocking device comprises a rod member 4 attached to an attachment structure 6 provided with a magnetic member 22 protruding from the surface of the attachment structure 6 that faces the mounting structure 8 provided above the attachment structure 6. The mounting structure 8 is provided with a magnetic member 24 having an outer surface aligned with the surface of the mounting structure 8 that faces the attachment structure 6.

Figure 4E:
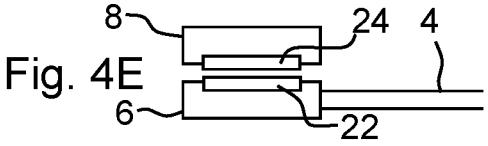
FIG. 4E shows a close-up view of the proximal portion of a blocking device according to the invention.

FIG. 4E illustrates a close-up view of the proximal portion of a blocking device according to the invention. The blocking device comprises a rod member 4 attached to an attachment structure 6 provided with a magnetic member 22 protruding from the surface of the attachment structure 6 that faces the mounting structure 8 provided above the attachment structure 6. The mounting structure 8 is provided with a magnetic member 24 protruding from the surface of the mounting structure 8 that faces the attachment structure 6.

Figure 4F:
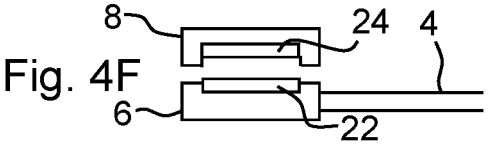
FIG. 4F shows a close-up view of the proximal portion of another blocking device according to the invention.

FIG. 4F illustrates a close-up view of the proximal portion of another blocking device according to the invention. The blocking device comprises a rod member 4 attached to an attachment structure 6 provided with a magnetic member 22 protruding from the surface of the attachment structure 6 that faces the mounting structure 8 provided above the attachment structure 6. The mounting structure 8 is provided with an outer surface facing the attachment structure 6, wherein the outer surface protrudes from the magnetic member 24.

Figure 4G:
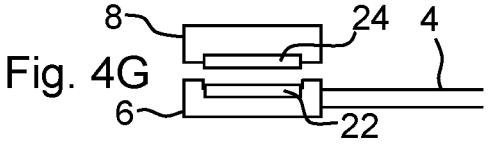
FIG. 4G shows a close-up view of the proximal portion of a further blocking device according to the invention

FIG. 4G illustrates a close-up view of the proximal portion of a further blocking device according to the invention. The blocking device comprises a rod member 4 attached to an attachment structure 6 provided with a magnetic member 22 having an outer surface protruding from the surface of a magnetic member 22 attached to the attachment structure 6. A mounting structure 8 is provided with a magnetic member 24 having an outer surface protruding from the outer surface facing the attachment structure 6.

FIG. 5A illustrates a front view of a blocking device 2 according to the invention. The blocking device 2 comprises a telescopic rod member 4 comprising a plurality of segments slidably arranged within another. The blocking device 2 further comprises an attachment structure 6 provided with a magnetic member attached to the attachment structure 6. The blocking device 2 comprises a mounting structure 8 provided with a magnetic member configured to be brought into contact with the magnetic member of the attachment structure 6. The rod member 4 is arranged in an upright position parallel with the wall 16'. The blocking device 2 does not prevent the shower curtain 10 arranged on the suspension rod 12 from being sucked into the shower cabinet defined by the walls 16, 16'.

FIG. 5B illustrates a front view of the blocking device 2 shown in FIG. 5A in a configuration in which the rod member 4 of the blocking device 2 has been rotated (indicated by a dotted arced line). In this configuration, the blocking device 2 is capable of preventing the shower curtain 10 from being sucked into the shower cabinet defined by the walls 16, 16'.

FIG. 5C illustrates a front view of the blocking device 2 shown in FIG. 5A in a configuration in which the segments of the rod member 4 are pressed together. In this configuration, the blocking device 2 is not capable of preventing the shower curtain 10 from being sucked into the shower cabinet defined by the walls 16, 16'.

FIG. 5D illustrates a front view of the blocking device 2 shown in FIG. 5A in a configuration in which the rod member 4 and the attachment structure 6 have been detached from the mounting structure 8. Accordingly, the magnetic member 22 attached to the mounting structure 8 is visible in FIG. 5D.

LIST OF REFERENCE NUMERALS

2 Blocking Device
4, 4' Rod member
6 Attachment structure
8 Mounting member
10 Shower curtain
12 Suspension member
14, 14' Ring member
16, 16', 16", 16''' Wall
18 Shower
20 User
22 Magnet
24 Magnet
26, 26', 26", 26''' Segment
28 Hinge
30 First portion
32 Second portion
34, 34' Screw
36 Adhesive
38, 38' Suction cup
F Force

The invention claimed is:

1. A shower curtain blocking device for preventing the motion of a shower curtain arranged in a shower cabinet comprising one or more walls, wherein the blocking device comprises a rod member configured to be arranged in a position in which rod member prevents the shower curtain from being sucked into the shower cabinet, characterised in that the blocking device comprises a mounting element configured to enable the rod member to be detachably attached to a wall by means of the mounting element configured to be attached to the wall, and in that the blocking device comprises:

an attachment structure attached to the proximal end of the rod member and a mounting member comprising a first surface configured to be attached to the wall, wherein a magnetic member is attached to the attachment structure and that magnetic member is attached to the mounting member, wherein the magnetic members are configured and arranged to be attached to each other by means of magnetic attraction between the magnetic members.

2. A blocking device according to claim 1, characterised in that the blocking device comprises one or more suction cups arranged in a position in which they can be attached to the wall and hereby detachably attach the blocking device to the wall.

3. A blocking device according to claim 1, characterised in that the rod member is a telescopic rod member comprising a plurality of segments, wherein the adjacent segments are slidably arranged within another.

4. A blocking device according to claim 1, characterised in that the mounting structure comprises a first portion and a second portion attached to each other.

5. A blocking device according to claim 4, characterised in that the first portion and the second portion are rotatably attached to each other by a hinge.

6. A blocking device according to claim 1, characterised in that the mounting structure comprises a surface provided with an adhesive member.

7. A blocking device according to claim 1, characterised in that the magnetic member of the attachment structure or the mounting structure protrudes from the attachment structure or the mounting structure, respectively.

8. A blocking device according to claim 1, characterised in that the magnetic member of the mounting structure and a surface of the mounting structure are aligned.

* * * * *